US009184547B2

(12) United States Patent
Shiroshita et al.

(10) Patent No.: US 9,184,547 B2
(45) Date of Patent: Nov. 10, 2015

(54) PLUG CONVERSION ADAPTER

(71) Applicant: SHIROSHITA INDUSTRIAL CO., LTD, Nagano (JP)

(72) Inventors: Toru Shiroshita, Nagano (JP); Hiroyuki Hiraide, Nagano (JP)

(73) Assignee: SHIROSHITA INDUSTRIAL CO., LTD., Nagano (JP)

( * ) Notice: Subject to any disclaimer, the term of this patent is extended or adjusted under 35 U.S.C. 154(b) by 0 days.

(21) Appl. No.: 14/484,301

(22) Filed: Sep. 12, 2014

(65) Prior Publication Data

US 2015/0194778 A1 Jul. 9, 2015

(30) Foreign Application Priority Data

Jan. 8, 2014 (JP) ..... 2014-001485

(51) Int. Cl.

| | |
|---|---|
| ***H01R 4/66*** | (2006.01) |
| ***H01R 31/06*** | (2006.01) |
| ***H01R 13/453*** | (2006.01) |
| ***H01R 13/42*** | (2006.01) |
| ***H01R 13/502*** | (2006.01) |
| ***H01R 27/00*** | (2006.01) |

(52) U.S. Cl.

CPC ..... *H01R 31/06* (2013.01); *H01R 13/42* (2013.01); *H01R 13/453* (2013.01); *H01R 13/502* (2013.01); *H01R 27/00* (2013.01)

(58) Field of Classification Search

CPC ..... H01R 24/30; H01R 31/06; H01R 27/00
USPC ..... 439/103, 174
See application file for complete search history.

(56) References Cited

U.S. PATENT DOCUMENTS

| | | | | |
|---|---|---|---|---|
| 6,780,034 | B2 | 8/2004 | Shiroshita et al. | |
| 9,059,547 | B2 * | 6/2015 | McLawhorn | 439/103 |
| 2012/0130365 | A1 | 5/2012 | McLawhorn | |

FOREIGN PATENT DOCUMENTS

| | | |
|---|---|---|
| JP | 2008198498 | 8/2008 |
| WO | 0161793 | 8/2001 |
| WO | 2011146809 | 11/2011 |

* cited by examiner

*Primary Examiner* — Tho D Ta
(74) *Attorney, Agent, or Firm* — Young & Thompson

(57) ABSTRACT

Provided is a plug conversion adapter which can easily open a shutter even in the case of a BF type AC power plug socket and can also be used in other types of AC power plug sockets. The interval between a pair of electrode pins can be controlled by operating a pair of first movable members, and thus the plug conversion adapter can be used in a larger number of types of AC power plug sockets. The interval between the pair of first movable members is restricted by a second movable member at a maximum, and thus a shutter can also be easily opened even in the case of an AC power plug socket that has a structure in which the shutter is opened by pushing both corners of the pair of electrode pin insertion openings.

8 Claims, 12 Drawing Sheets

2
28A
28B 2
28A
28B
10
5A
5B
16
20
22
23

2
28A
28B
10
6
5A
5B
19
29
20
22
23

21
21A
21B 2
28A
10
5A
20
23

2
28B
10
5B
20
22

A

02

B.C.SE

B3

PLUG CONVERSION ADAPTER

BACKGROUND OF THE INVENTION

1. Field of the Invention

The present invention relates to a plug conversion adapter which is used to convert a predetermined type of plug such as a plug that is inserted into an AC power plug socket into other types of plugs.

2. Description of the Related Art

There are various types of AC power plug sockets in the world. Therefore, in a case where electric appliances in Japan are used overseas, an adapter which converts a plug to be appropriate for the AC power plug socket of the country is needed. In JP 3946491 B1 described as follows, an adapter for overseas plug sockets capable of converting the shapes, arrangement, the number, and the like of electrode pins to be appropriate for AC power plug sockets (BF, B3, B, C, SE, and O) in various overseas standards is described.

SUMMARY OF THE INVENTION

The adapter described in JP 3946491 B1 has a structure in which the interval between the electrode pins (plug terminals) can be controlled to be appropriate for various types of AC power plug sockets having different intervals between electrode insertion openings. A pair of electrode pins are, for example, connected to a pair of sliding members provided in a casing of the adapter. The pair of sliding members are biased by a spring or the like in a direction in which they become separated from each other. End portions of the pair of sliding members protrude outward from holes that are open to both sides of the casing as push buttons. By pushing a pair of push buttons against the biasing force of the spring or the like, the interval between the pair of electrode pins can be narrowed.

In addition, among overseas AC power plug sockets, there is a type of plug socket in which insertion openings for the electrode pins are opened and closed by a shutter for safety. For example, BF type AC power plug sockets which are used in United Kingdom, Hong Kong, and the like have a structure in which the shutter of a pair of electrode pin insertion openings is not opened when appropriate pins are not inserted into earth insertion openings.

Among the BF type AC power plug sockets, there is a type of plug socket in which the shutter is opened and closed by a structure different from the above-describe structure. That is, the structure is a shutter structure in which the shutter is opened as the pair of electrode pins push both corners (corners at the maximum interval) of the pair of electrode pin insertion openings from the above of the shutter. According to the shutter structure, incorrect insertion of electrode pins (particularly, electrode pins having circular cross-sections such as B type, C type, and the like) which do not have original shapes, that is, prismatic shapes is prevented.

However, in the case of AC power plug sockets that have a structure in which the shutter is opened as the pair of electrode pins push both corners of the pair of electrode pin insertion openings, there is a problem in that it is difficult to open the shutter in the above-described adapter according to the related art. That is, even when both corners of the pair of electrode pin insertion openings are tried to be pushed by the pair of electrode pins, since the interval between the pair of electrode pins in the adapter according to the related art is easily changed, there may be cases where it is difficult to appropriately push both corners.

The invention has been made taking the foregoing circumstances into consideration, and an object thereof is to provide a plug conversion adapter which can cope with a plurality of types of plugs in which electrode pins have different shapes, and can easily open a shutter even in the case of AC power plug sockets that have a structure in which the shutter is opened as a pair of electrode pins push both corners of a pair of electrode pin insertion openings.

BRIEF DESCRIPTION OF THE DRAWINGS

FIG. 1A is a front view, FIG. 1B is a rear view, FIG. 1C is a plan view, FIG. 1D is a bottom view, FIG. 1E is a right side view, and FIG. 1F is a left side view;

FIG. 2A is a front view, FIG. 2B is a rear view, FIG. 2C is a plan view, FIG. 2D is a bottom view, FIG. 2E is a right side view, and FIG. 2F is a left side view;

FIG. 3A is a perspective view viewed from a tip end side, and FIG. 3B is a perspective view viewed from a rear surface side;

FIG. 4A is a perspective view viewed from a tip end side, and FIG. 4B is a perspective view viewed from a rear surface side;

FIG. 5A is a perspective view viewed from a tip end side, and FIG. 5B is a perspective view viewed from a rear surface side;

FIG. 6A is a perspective view viewed from a tip end side, and FIG. 6B is a perspective view viewed from a rear surface side;

FIG. 7A is a perspective view viewed from a tip end side, and FIG. 7B is a perspective view viewed from a rear surface side;

FIG. 8A is a perspective view viewed from a tip end side, and FIG. 8B is a perspective view viewed from a rear surface side;

FIG. 9A illustrates a case where the interval between a pair of electrode pins is minimized, and FIG. 9B illustrates a case where the interval between the pair of electrode pins is maximized;

FIG. 10A illustrates a state where one casing member is detached, and FIG. 10B illustrates a state where the other casing member is detached;

FIG. 11A illustrates the first position of the movement operating portion in the long hole, FIG. 11B illustrates a case where the interval between the electrode pins is large in a state where strokes of first movable members are enabled, and FIG. 11C illustrates a case where the interval between the pair of electrode pins is small in the state where the strokes of the first movable members are enabled; FIG. 12A illustrates the second position of the movement operating portion in the long hole, and FIG. 12B illustrates a state where the interval between the pair of electrode pins is fixed to be large in a state where the strokes of the first movable members are fixed.

DETAILED DESCRIPTION OF THE PREFERRED EMBODIMENTS

Figure 1C:
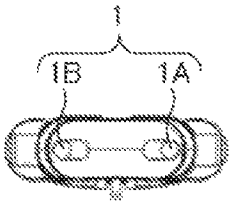
FIGS. 1A to 1F are views illustrating an example of a plug conversion adapter according to an embodiment of the invention.
Figure 1B:
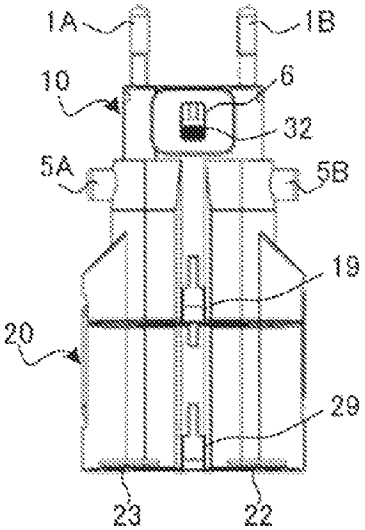
Figure 1E:
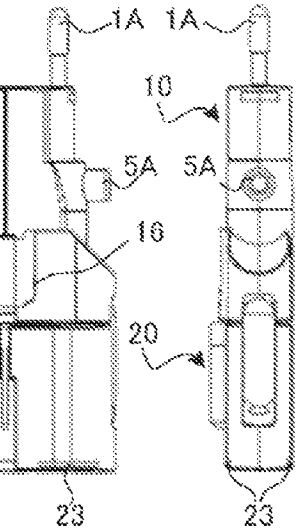
Figure 1A:
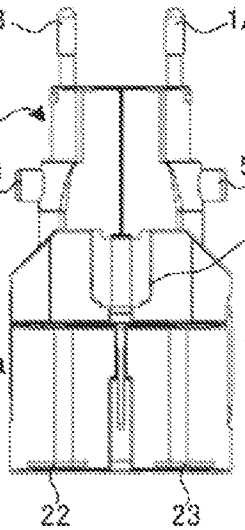
Figure 1F:
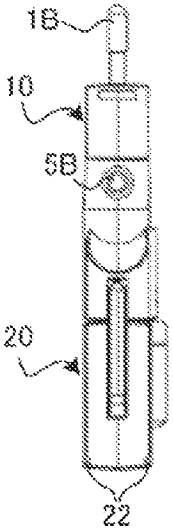
Figure 1D:
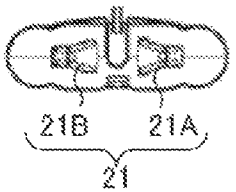

FIGS. 1A to 1F are views illustrating an example of a plug conversion adapter according to an embodiment of the invention. FIG. 1A is a front view, FIG. 1B is a rear view, FIG. 1C is a plan view, FIG. 1D is a bottom view, FIG. 1E is a right side view, and FIG. 1F is a left side view. The plug conversion adapter illustrated in FIGS. 1A to 1F includes two casings (a first casing 10 and a second casing 20), each of which includes sockets and electrode pins. In the example of FIGS. 1A to 1F, electrode pins 24A and 24B (FIGS. 3A to 5B) of the second casing 20 are inserted into sockets 7 (FIGS. 6A to 8B) of the first casing 10. By assembling the first casing 10 and the second casing 20 as illustrated in FIGS. 1A to 1F, the total size is reduced, and transportation becomes easy.

Figures 2A, 2B, 2C, 2D, 2E, 2F:
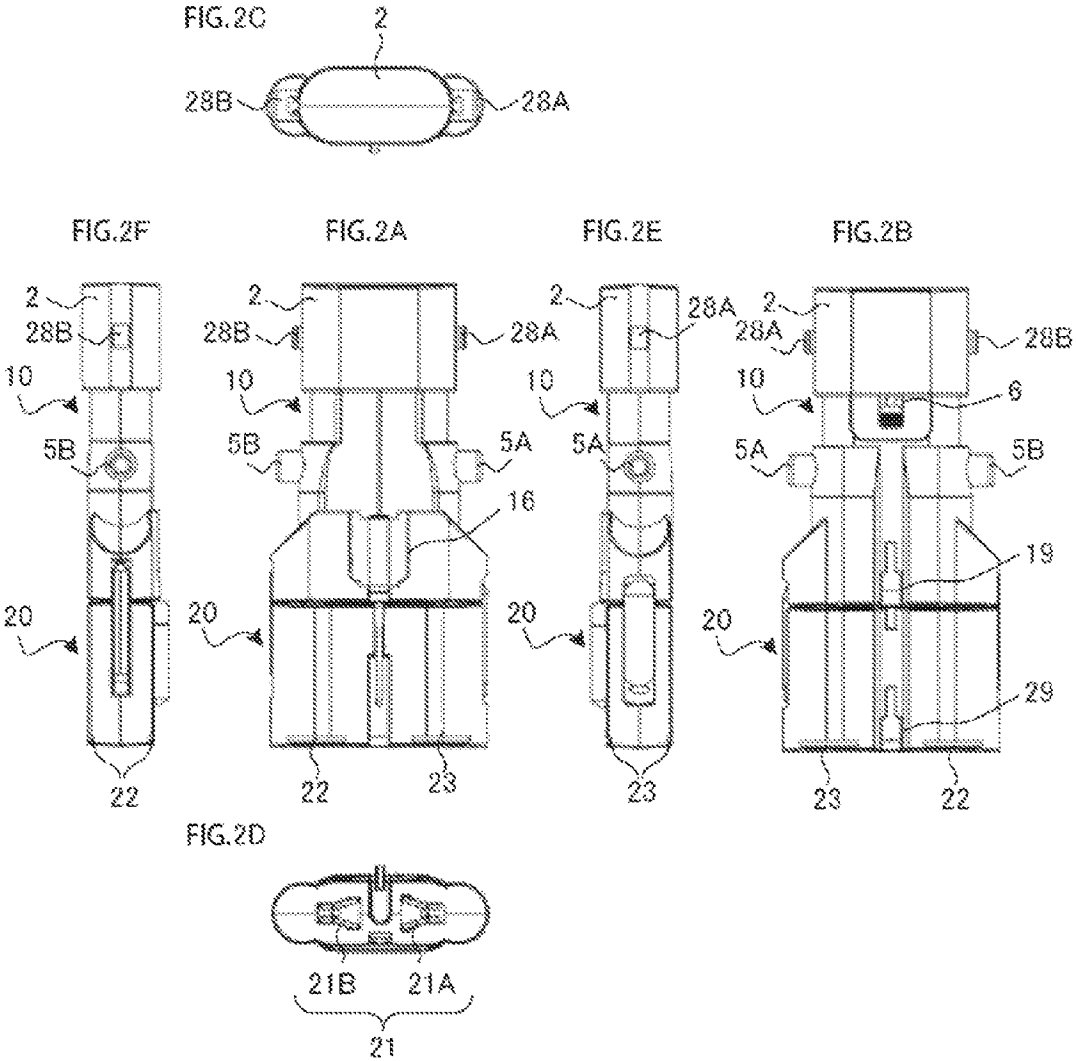
FIGS. 2A to 2F are views illustrating a state where a cap is mounted on the plug conversion adapter illustrated in FIGS. 1A to 1F.

FIGS. 2A to 2F are views illustrating a state where a cap is mounted on the plug conversion adapter illustrated in FIGS. 1A to 1F. FIG. 2A is a front view, FIG. 2B is a rear view, FIG. 2C is a plan view, FIG. 2D is a bottom view, FIG. 2E is a right side view, and FIG. 2F is a left side view. Electrode pins 1A and 1B protrude to be parallel to each other from the side surface on the tip end side of the first casing 10 of the plug conversion adapter (FIGS. 1A to 1F). As illustrated in FIGS. 2A to 2F, a cap 2 is detachably mounted on the tip end portion of the plug conversion adapter. The cap 2 is formed of a material such as a synthetic resin, and has an elongated cylindrical shape in which the top portion is blocked. Since the cap 2 is mounted on the tip end portion of the plug conversion adapter, the electrode pins 1A and 1B can be covered and protected by the cap 2, and thus the electrode pins 1A and 1B can be prevented from being damaged during transportation. Protrusions 28A and 28B having a T-shaped transverse cross-section are provided on both side surfaces of the cap 2 in the width direction to detachably mount the cap 2 on a groove portion 19 or 29 of the first casing 10 or the second casing 20.

Figures 3A, 3B:
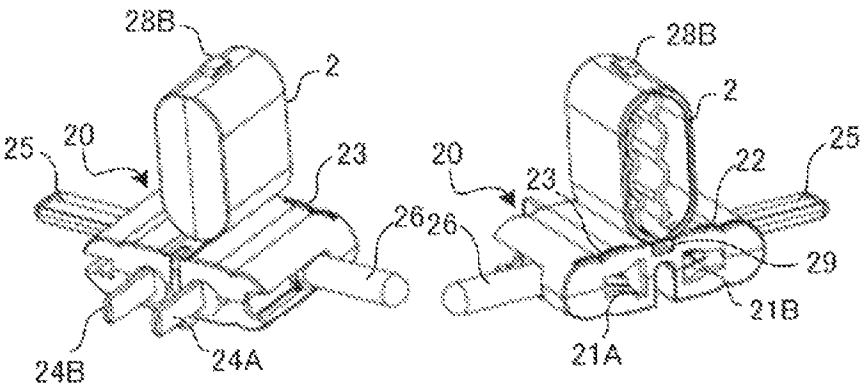
FIGS. 3A and 3B are views illustrating an example of the exterior of the plug conversion adapter illustrated in FIGS. 1A to 1F in the case of being used in an A type AC power plug socket.
Figure 6A:
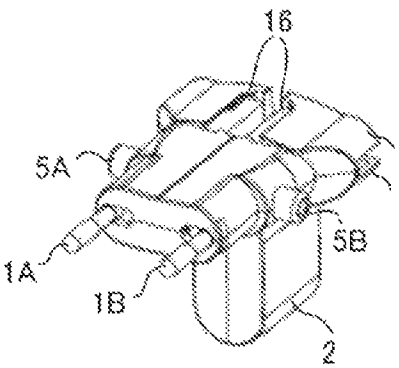
FIGS. 6A and 6B are views illustrating an example of the exterior of the plug conversion adapter illustrated in FIGS. 1A to 1F in the case of being used in a B, SE, or C type AC power plug socket.
Figure 6B:
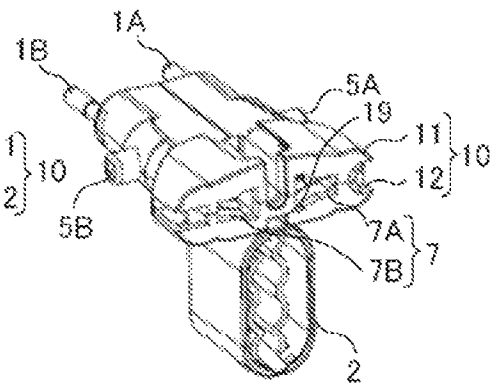
Figure 7B:
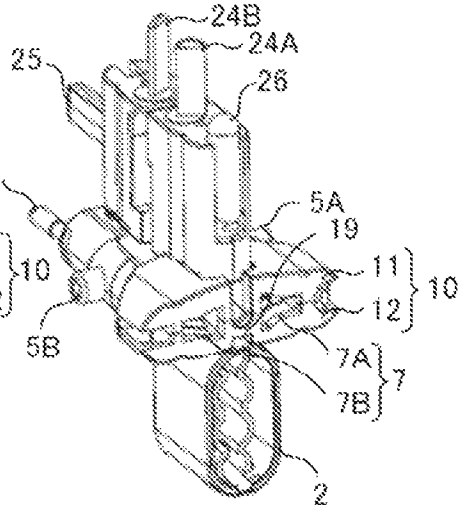
FIGS. 7A and 7B are views illustrating an example of the exterior of the plug conversion adapter illustrated in FIGS. 1A to 1F in the case of being used in a BF type AC power plug socket.
Figure 7A:
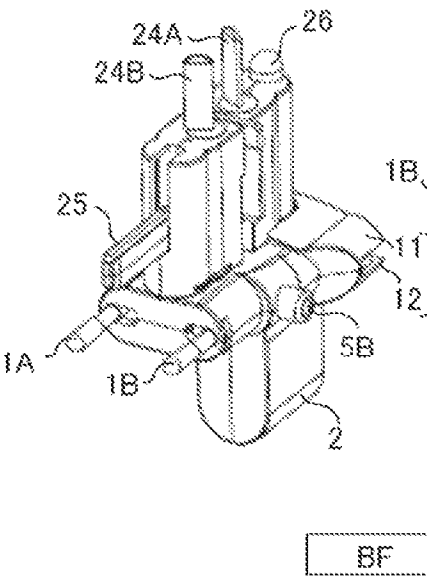
Figure 8B:
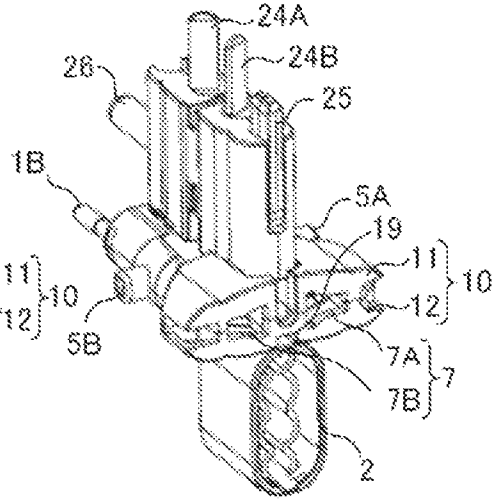
FIGS. 8A and 8B are views illustrating an example of the exterior of the plug conversion adapter illustrated in FIGS. 1A to 1F in the case of being used in a B3 type AC power plug socket.

FIGS. 3A to 8B are views illustrating examples of the exterior of the plug conversion adapter in the case of being used in various types of AC power plug sockets (A, O, O2, B, SE, C, BF, and B3). FIGS. 3A and 3B illustrate an example of the exterior in the case of the A type, FIGS. 4A and 4B illustrate an example of the exterior in the case of the O type, FIGS. 5A and 5B illustrate an example of the exterior in the case of the O2 type, FIGS. 6A and 6B illustrate an example of the exterior in the case of the B, SE, and C types, FIGS. 7A and 7B illustrate an example of the exterior in the case of the BF type, and FIGS. 8A and 8B illustrate an example of the exterior in the case of the B3 type.

In the A, O, and O2 type AC power plug sockets, as illustrated in FIGS. 3A to 5B, the second casing 20 is used as a single body. In the B, SE, and C type AC power plug sockets, as illustrated in FIGS. 6A and 6B, the first casing 10 is used as a single body. In the BF and B3 type AC power plug sockets, as illustrated in FIGS. 7A to 8B, the first casing 10 and the second casing 20 are used in a combination thereof.

First, the second casing 20 will be described.

Figure 4B:
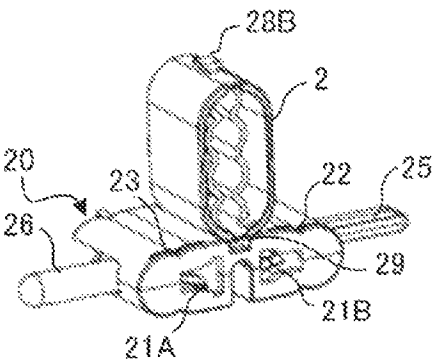
FIGS. 4A and 4B are views illustrating an example of the exterior of the plug conversion adapter illustrated in FIGS. 1A to 1F in the case of being used in an O type AC power plug socket.
Figure 4A:
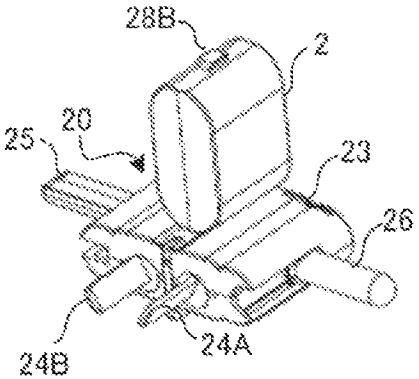
Figure 5A:
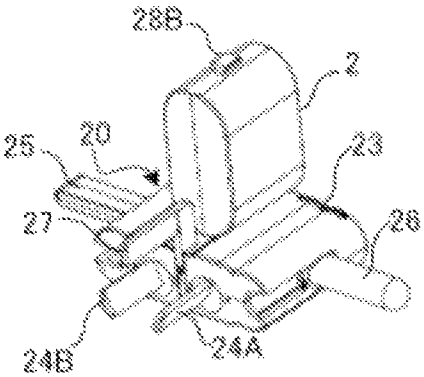
FIGS. 5A and 5B are views illustrating an example of the exterior of the plug conversion adapter illustrated in FIGS. 1A to 1F in the case of being used in an O2 type AC power plug socket.
Figure 5B:
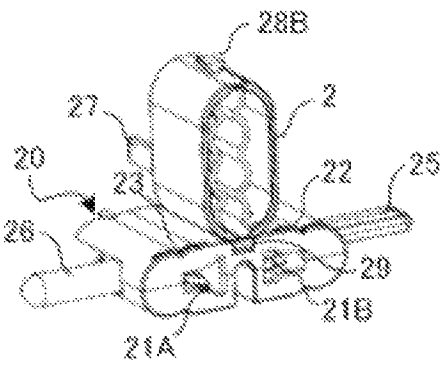

The second casing 20 has a thin box shape in which both end portions in the width direction are rounded, sockets 21 (FIGS. 1D, 2D, 3B, 4B, and 5B) are provided on one side surface thereof, and the pair of electrode pins 24A and 24B are provided on the other side surface that opposes one side surface (FIGS. 3A, 4A, and 5A). The sockets 21 have a pair of female contacts 21A and 21B for accommodating a pair of electrode pins provided in a predetermined type of power plug. The pair of electrode pins 24A and 24B each have an elongated plate shape, and protrude from the other side surface of the second casing 20 to be parallel to each other. The female contact 21A is electrically connected to the electrode pin 24A, and the female contact 21B is electrically connected to the electrode pin 24B.

The pair of electrode pins 24A and 24B are rotatably supported in the second casing 20 to be rotatable about rotational axes parallel to the protrusion direction thereof. Therefore, the inclinations of the surfaces of the pair of electrode pins 24A and 24B can be controlled as illustrated in FIGS. 3A, 4B, and 5A. In the case of use in the A type AC power plug socket, the surfaces of the pair of electrode pins 24A and 24B are parallel to each other (FIG. 3A). In the case of use in the O or O2 type AC power plug socket, the surfaces of the pair of electrode pins 24A and 24B are inclined so as not to be parallel to each other (FIGS. 4B and 5A).

In addition, in the second casing 20, an earth insertion opening pin 27 which is used for the O2 type AC power plug socket is foldably provided (FIG. 5A). The earth insertion opening pin 27 is a pin which is inserted into an earth insertion opening of the O2 type AC power plug socket to open a shutter. The earth insertion opening pin 27 is formed by a plate-like member which is bent in an L-shape at a side surface thereof. An end of the L-shaped plate-like member is rotatably supported in the middle between the pair of electrode pins 24A and 24B in the second casing 20. In the case of the O2 type AC power plug socket, the earth insertion opening pin 27 is in a state of protruding to be parallel to the electrode pins 24A and 24B. In the case of other types of AC power plug sockets, the earth insertion opening pin 27 is in a state of being folded in a groove provided in the second casing 20.

Furthermore, in the second casing 20, an earth insertion opening pin 25 which is used in the BF type AC power plug socket and an earth insertion opening pin 26 which is used in the B3 type AC power plug socket are foldably provided (FIGS. 3A to 5B). Both earth insertion opening pins 25 and 26 are pins which are inserted into earth insertion openings to open shutters. The earth insertion opening pin 25 has an elongated plate shape, and the earth insertion opening pin 26 has a columnar shape with a rounded tip end portion.

Grooves are respectively formed in two opposing side surfaces of the second casing 20 (side surfaces where the sockets 21 and the electrode pins 24A and 24B are not provided). An end of the earth insertion opening pin 25 is rotatably supported in one groove, and an end of the earth insertion opening pin 26 is rotatably supported in the other groove. The earth insertion opening pins 25 and 26 are in a state of protruding from the side surfaces of the second casing 20 in use, and are in a state of being folded in the grooves not in use.

Figure 8A:
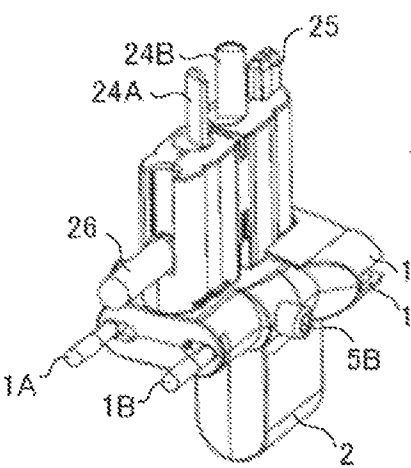

In portions in the second casing 20 which are close to the side surface portion where the sockets 21 are formed, grooves 22 and 23 which extend to be parallel to the edge of the side surface portion are formed. The grooves 22 and 23 can be fitted to protrusions 16 (FIGS. 1A and 6A) which are formed in the first casing 10. As the grooves 22 or the grooves 23 are fitted to the protrusions 16, the second casing 20 is in a state of being detachably mounted on the first casing 10 (FIGS. 7A to 8B). In a case where the earth insertion opening pin 25 is used, the earth insertion opening pin 25 is directed to the electrode pins 1A and 1B sides, and the grooves 23 of the second casing 20 are fitted to the protrusions 16 of the first casing 10 (FIGS. 7A and 7B). In a case where the earth insertion opening pin 26 is used, the earth insertion opening pin 26 is directed to the electrode pins 1A and 1B side, and the grooves 22 of the second casing 20 are fitted to the protrusions 16 of the first casing 10 (FIGS. 8A and 8B). The protrusions 16 of the first casing 10 are an example of mounting portions in the invention. The protrusions 16 of the first casing 10 are formed on the surface that opposes the surface where a long hole 6, which will be described later, (FIGS. 1A and 1B) is formed. Therefore, a movement operating portion 32 (FIG. 1B) of a second movable member 3 which penetrates through the long hole 6 is in a state of being exposed to the outside of the first casing 10 even in a state where the second casing 20 is mounted on the first casing 10, and thus can be easily operated. The movement operating portion 32 of the second movable member 3 which penetrates through the long hole 6 is used in an operation of fixing the width between the pair of electrode pins 1A and 1B to be maximized in the BF type AC power plug socket (FIGS. 7A and 7B).

The second casing 20 has been described hereinbefore.

Next, the first casing 10 will be described.

Similarly to the second casing 20, the first casing 10 has a thin box shape in which both end portions in the width direction are rounded, sockets 7 (FIGS. 6B, 7B, and 8B) are provided on one side surface thereof, and the pair of electrode pins 1A and 1B are provided on the other side surface that opposes one side surface (FIGS. 6A, 7A, and 8A). The transverse width of the first casing 10 on the pair of electrode pins 1A and 1B side is smaller than that on the sockets 7 side. The sockets 7 have a pair of female contacts 7A and 7B (FIGS. 6B, 7B, and 8B) for accommodating a pair of electrode pins provided in a predetermined type of power plug. The pair of electrode pins 1A and 1B have a columnar shape with a rounded tip end portion, and protrude from one side surface of the first casing 10 to be parallel to each other. The female contact 7A is electrically connected to the electrode pin 1A, and the female contact 7B is electrically connected to the electrode pin 1B.

A pair of first movable members 5A and 5B which respectively hold the pair of electrode pins 1A and 1B are provided in the first casing 10 (FIGS. 1A to 1F and 6A to 8B). The pair of first movable members 5A and 5B are movably disposed in the first casing 10 so as to move in a direction in which the interval between the pair of electrode pins 1A and 1B is changed while holding the pair of electrode pins 1A and 1B to be parallel to each other. By operating the pair of first movable members 5A and 5B, the interval between the pair of electrode pins 1A and 1B can be controlled according to the types (B, SE, C, and B3) of AC power plug sockets (FIGS. 6A, 6B, 8A, and 8B).

In FIGS. 3A to 8B, the cap 2 is detachably attached to a groove portion 19 or 29 of the first casing 10 or the second casing 20 by using the protrusions 28A and 28B on both side surfaces of the cap 2 in the width direction. The cap 2 also functions as a female connector for inserting a three-pin plug (not illustrated).

The internal structure of the first casing 10 will be described with reference to FIGS. 9A to 12B.

Figure 9B:
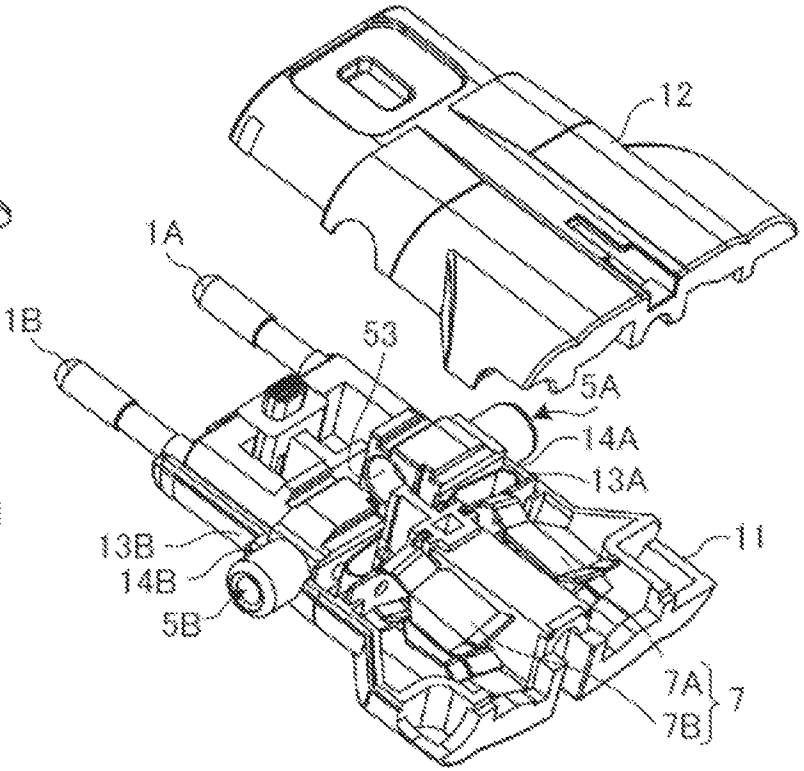
FIGS. 9A and 9B are perspective views illustrating a state where a part of a first casing is detached.
Figure 9A:
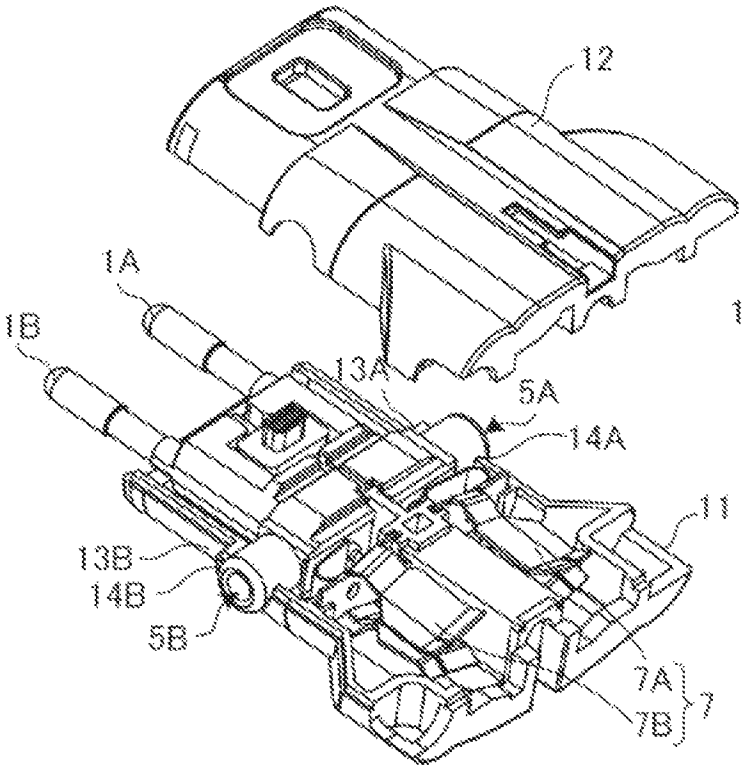

FIGS. 9A and 9B are perspective views illustrating a state where a part of the first casing 10 is detached. The first casing 10 is divided into two members (casing members 11 and 12) in the vicinity of the center of the side surface thereof (FIGS. 6A to 8B). The perspective views of FIGS. 9A and 9B illustrate a state where one (the casing member 12) of the two members is detached. FIG. 9A illustrates a case where the interval between the pair of electrode pins 1A and 1B is minimized, and FIG. 9B illustrates a case where the interval between the pair of electrode pins 1A and 1B is maximized. As illustrated in FIGS. 9A and 9B, in the first casing 10, the pair of first movable members 5A and 5B which respectively hold the pair of electrode pins 1A and 1B and a first elastic member 9 which biases the first movable members 5A and 5B in a direction in which they become separated from each other are provided (FIGS. 11B, 11C, and 12B). The first elastic member 9 is configured by using, for example, a metal spring or the like.

Figure 10A:
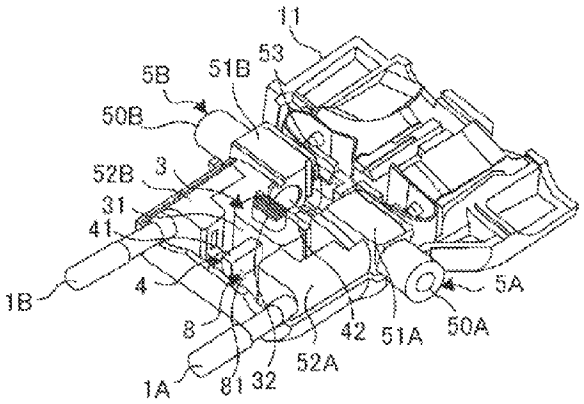
FIGS. 10A and 10B are perspective views illustrating a state where a part of the first casing is detached.
Figure 10B:
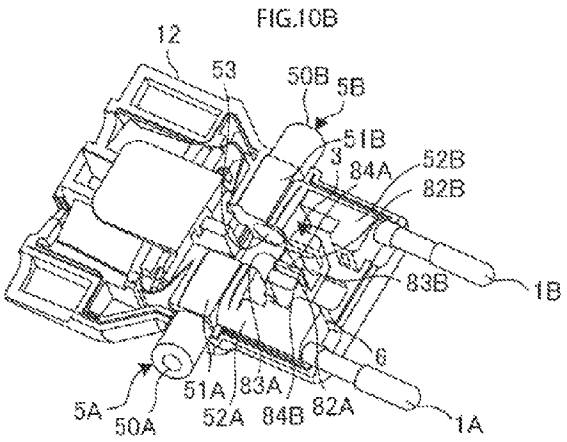

FIGS. 10A and 10B are perspective views illustrating a state where a part of the first casing 10 is detached. FIG. 10A is the perspective view illustrating a state where one casing member 12 is detached. FIG. 10B is the perspective view illustrating a state where the other casing member 11 is detached. The pair of first movable members 5A and 5B are respectively constituted by operating portions 50A and 50B which protrude outward from the first casing 10, wide portions 51A and 51B which are disposed on the base end sides of the operating portions 50A and 50B to restrict the outward movement of the operating portions 50A and 50B, and engaging portions 52A and 52B which extend from the wide portions 51A and 51B to the tip end side. The operating portions 50A and 50B have a columnar shape, and the wide portions 51A and 51B at the base portions thereof have a rectangular parallelepiped shape. The planar shapes of the engaging portions 52A and 52B have an inverted L-shape. The operating portions 50A and 50B, the wide portions 51A and 51B, and the engaging portions 52A and 52B are, for example, integrally formed of a material such as a synthetic resin having appropriate strength and insulating properties.

The first elastic member 9 is disposed in columnar holes 53 formed in the opposing surfaces of the wide portions 51A and 51B. The pair of first movable members 5A and 5B are biased by the first elastic member 9 in a direction in which they become separated from each other. The opposing surfaces of engaging portions 52A and 52B having the inverted L shape are disposed at an interval. The pair of electrode pins 1A and 1B are inserted into the wide portions 51A and 51B and the engaging portions 52A and 52B. The pair of first movable members 5A and 5B are movably disposed in the first casing 10 so as to move in a direction in which the interval between the pair of electrode pins 1A and 1B is changed while holding the pair of electrode pins 1A and 1B to be parallel to each other.

In the first casing 10, a pair of locking portions 13A and 13B are formed to restrict a movable range of the pair of electrode pins 1A and 1B which are moved by the biasing force of the first elastic member 9 in a direction in which they are separated from each other (FIGS. 9A and 9B). The pair of locking portions 13A and 13B restrict the movable range of the pair of electrode pins 1A and 1B to a certain range by locking the wide portions 51A and 51B of the pair of first movable members 5A and 5B which receive the biasing force of the first elastic member 9 (FIGS. 9A to 10B). In a state where the pair of locking portions 13A and 13B lock the pair of wide portions 51A and 51B, the interval between the pair of electrode pins 1A and 1B is maximized (FIG. 9B). In the example of FIGS. 9A and 9B, the locking portions 13A and 13B include a pair of openings 14A and 14B which are formed to allow the penetration of the operating portions 50A and 50B of the first movable members 5A and 5B and to prevent the penetration of the wide portions 51A and 51B of the first movable members 5A and 5B that are positioned closer to the inside than the operating portions 50A and 50B (FIGS. 9A to 10B).

The operating portions 50A and 50B of the pair of the first movable members 5A and 5B are exposed to the outside from the pair of openings 14A and 14B formed in the first casing 10 by the biasing force of the first elastic member 9. By pushing back the operating portions 50A and 50B of the first movable members 5A and 5B which are exposed to the outside toward the inside of the first casing 10 against the biasing force of the first elastic member 9, the interval between the pair of electrode pins 1A and 1B is narrowed.

As illustrated in FIGS. 10A and 10B, the second movable member 3 and an engaging mechanism 8 which releasably fixes the position of the second movable member 3 are provided between the pair of engaging portions 52A and 52B in the first casing 10.

As illustrated in FIG. 10A, a body portion 31 of the second movable member 3 is a door-shaped rectangular member, and the top portion thereof includes the movement operating portion 32 which has a width smaller than that of the body portion 31 and protrudes in a rectangular parallelepiped shape. The movement operating portion 32 of the second movable member 3 penetrates through the long hole 6 formed in the first casing 10, and thus is in a state of being exposed to the outside of the first casing 10 (FIG. 1B). The long hole 6 is formed in the first casing 10 to extend in the direction parallel to the pair of electrode pins 1A and 1B, and prevents the penetration of the body portion 31 of the second movable member 3 formed to have a width greater than that of the movement operating portion 32 while allowing the penetration of the operating portion 32.

An inverted T-shaped guide member 4 which guides the sliding movement of the second movable member 3 protrudes between the first movable members 5A and 5B of the first casing member 11. The inverted T-shaped guide member 4 includes a guide portion 41 which is provided to be parallel to the pair of electrode pins 1A and 1B, and a restriction portion 42 which is provided to block the end portion of the guide portion 41 and restricts the sliding movement of the second movable member 3. The second movable member 3 is provided on the guide portion 41 and is disposed in the first casing 10 to slide along the guide portion 41. The movement operating portion 32 of the second movable member 3 is disposed to be exposed from the long hole 6 which is open in the casing member 12. When the movement operating portion 32 of the second movable member 3 is operated to move in the long hole 6, the body portion 31 of the second movable member 3 in the first casing 10 is moved in a direction parallel to the pair of electrode pins 1A and 1B along the guide portion 41 of the guide member 4 (FIG. 10B).

The transverse width of the body portion 31 of the second movable member 3 is set so that, when the interval between the engaging portions 52A and 52B of the pair of first movable members 5A and 5B is maximized, the body portion 31 of the second movable member 3 advances between the engaging portions 52A and 52B and restricts the interval between the engaging portions 52A and 52B. As illustrated in FIG. 10A, protrusions 81 protrude in the width direction from both side portions of the tip end side of the guide member 4 which extends to be parallel to the pair of electrode pins 1A and 1B. Meanwhile, as illustrated in FIG. 10B, a pair of oscillating walls 83A and 83B are formed inside the door-shaped body portion 31 of the second movable member 3 to be able to oscillate via slits 82A and 82B. The opposing surfaces of the pair of oscillating walls 83A and 83B are formed to have a two arc-shaped transverse cross-section.

Therefore, when the body portion 31 of the second movable member 3 is moved to the tip end side along the guide member 4, the two arc-shaped oscillating walls 83A and 83B oscillate on the slits 82A and 82B sides, and the protrusions 81 of the guide member 4 climb over the arc portions of the oscillating walls 83A and 83B and are engaged with trough portions 84A and 84B. That is, the protrusions 81 of the guide member 4 and the two arc-shaped oscillating walls 83A and 83B of the body portion 31 of the second movable member 3 constitute the engaging mechanism 8 of the plug conversion adapter according to this embodiment. The protrusions 81 of the guide member 4 and the two arc-shaped oscillating walls 83A and 83B of the body portion 31 of the second movable member 3 are an example of the engaging mechanism 8 of this embodiment.

Figure 11A:
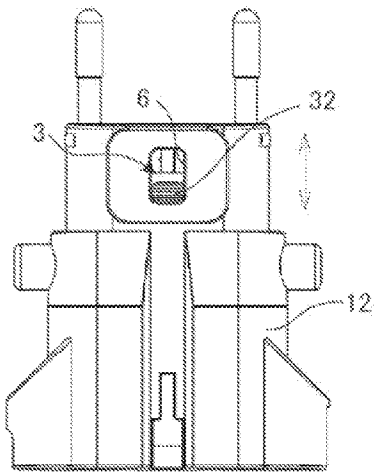
FIGS. 11A to 11C are plan views illustrating a state where a movement operating portion in a long hole of the first casing is at a first position.
Figure 11B:
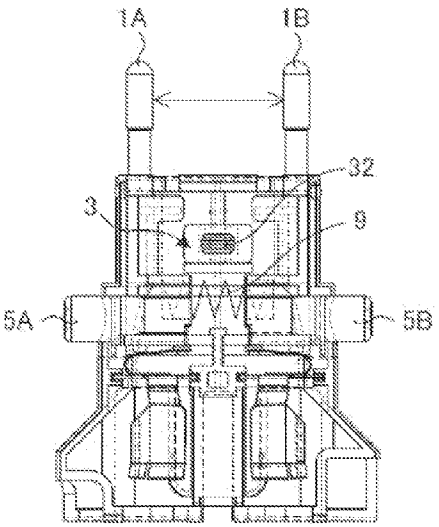
Figure 11C:
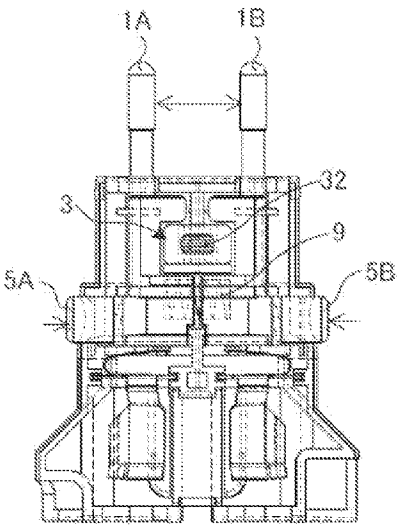

FIGS. 11A to 11C are plan views illustrating a state where the movement operating portion in the long hole of the first casing is at a first position. As illustrated in FIGS. 11A to 11C, the movement operating portion 32 of the second movable member 3 is at the first position on the rear end side which is distant from the pair of electrode pins 1A and 1B in the long hole 6 that is open in the casing member 12. When the movement operating portion 32 of the second movable member 3 is positioned at the first position, the movement of the pair of first movable members 5A and 5B is allowed, and the interval between the pair of electrode pins 1A and 1B is variable.

That is, by operating the operating portions 50A and 50B of the pair of first movable members 5A and 5B, the interval between the pair of electrode pins 1A and 1B can be changed. FIG. 11A illustrates a state where the movement operating portion 32 of the second movable member 3 in the long hole 6 is positioned at the first position. FIG. 11B illustrates a case where the interval between the pair of electrode pins 1A and 1B is large in a state where strokes of the first movable members 5A and 5B are enabled. FIG. 11C illustrates a case where the interval between the pair of electrode pins 1A and 1B is small in the state where the strokes of the first movable members 5A and 5B are enabled.

Figure 12A:
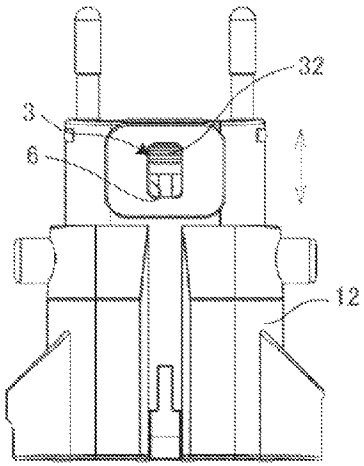
FIGS. 12A and 12B are plan views illustrating a state where the movement operating portion in the long hole of the first casing is at a second position.
Figure 12B:
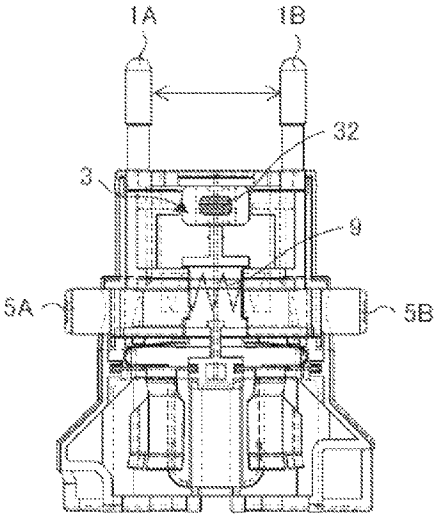

FIGS. 12A and 12B are plan views illustrating a state where the movement operating portion in the long hole of the first casing is at a second position. As illustrated in FIGS. 12A and 12B, the movement operating portion 32 of the second movable member 3 is at the second position on the tip end side which is close to the pair of electrode pins 1A and 1B in the long hole 6 that is open in the casing member 12. When the movement operating portion 32 of the second movable member 3 is positioned at the second position, the movement of the pair of first movable members 5A and 5B is restricted, and the interval between the pair of electrode pins 1A and 1B is fixed.

That is, the second movable member 3 enters the gap between the pair of first movable members 5A and 5B so that the movement of the pair of first movable members 5A and 5B is restricted. Therefore, the operating portions 50A and 50B thereof cannot be operated. The interval between the pair of electrode pins 1A and 1B is held at the maximum interval by the second movable member 3. FIG. 12A illustrates a state where the movement operating portion 32 of the second movable member 3 in the long hole 6 is positioned at the second position. FIG. 12B illustrates a state where the interval between the pair of electrode pins 1A and 1B is fixed to be large in a state where the strokes of the first movable members 5A and 5B are fixed.

As described above, according to the plug conversion adapter according to this embodiment, the second movable member 3 can be moved between the first position at which the interval between the pair of electrode pins 1A and 1B is variable by allowing the movement of the pair of first movable members 5A and 5B, and the second position at which the interval between the pair of electrode pins 1A and 1B is fixed by restricting the movement of the pair of first movable members 5A and 5B. The second movable member 3 is positioned at the second position when the interval between the pair of electrode pins 1A and 1B is maximized, and thus releasably restrict the movement of the pair of electrode pins 1A and 1B by the first movable members 5A and 5B. Therefore, even in the case of a type (BF type or the like) of AC power plug socket in which a shutter is opened by pushing both corners (corners which are farthest from each other) of a pair of electrode pin insertion openings from above the shutter, the shutter can be easily opened by the pair of electrode pins 1A and 1B which are fixed at the maximum interval.

In addition, according to the plug conversion adapter according to this embodiment, the operating portions 50A and 50B of the pair of first movable members 5A and 5B are exposed to the outside from the pair of openings 14A and 14B formed in the first casing 10 by the biasing force of the first elastic member 9. The pair of locking portions 13A and 13B formed in the first casing 10 respectively lock the pair of first movable members 5A and 5B so that the pair of electrode pins 1A and 1B are not separated from each other over a certain movable range. By pushing back the operating portions 50A and 50B of the first movable members 5A and 5B which are exposed to the outside toward the inside of the first casing 10 against the biasing force of the first elastic member 9, the interval between the pair of electrode pins 1A and 1B can be changed. Therefore, the plug conversion adapter according to this embodiment can also be used in other types (B, SE, C, B3, and the like) of AC power plug sockets other than the BF type.

According to the plug conversion adapter according to this embodiment, the second movable member 3 includes the movement operating portion 32 which is allowed to penetrate through the long hole 6 that is open in the first casing 10 and is exposed to the outside of the first casing 10, and the body portion 31 which is formed to have a greater width than that of the movement operating portion 32 and is prevented from penetrating through the long hole 6. When the movement operating portion 32 of the second movable member 3 is operated to move in the long hole 6, the body portion 31 of the second movable member 3 in the first casing 10 is moved to slide in a direction parallel to the pair of electrode pins 1A and 1B along the guide member 4. Since the second movable member 3 is releasably fixed by the engaging mechanism 8 when positioned at the second position, the maximum interval between the pair of electrode pins 1A and 1B is held to be able to cope with the BF type AC power plug socket.

According to the plug conversion adapter according to this embodiment, when the body portion 31 of the second movable member 3 is moved to the second position on the tip end side along the guide member 4, the two arc-shaped oscillating walls 83A and 83B oscillate on the slits 82A and 82B sides, and the protrusions 81 of the guide member 4 climb over the arc portions of the oscillating walls 83A and 83B and are engaged with the trough portions 84A and 84B while being able to be disengaged therefrom. Therefore, according to the plug conversion adapter according to this embodiment, by providing the simple engaging mechanism 8, the second movable member 3 can be fixed at the second position at which the first movable members 5A and 5B are restricted, while being able to be engaged and disengaged.

The plug conversion adapter according to this embodiment includes the second casing 20 provided with the earth insertion opening pins 25, 26, and 27 that form different types of plugs with the pair of electrode pins 1A and 1B. Since the first casing 10 includes the mounting portions (protrusions 16), in which the second casing 20 is detachably mounted, on the surface that opposes the surface where the long hole 6 is formed, the plug conversion adapter can cope with the A, O, and O2 type AC power plug sockets.

According to the plug conversion adapter according to this embodiment, since the pair of electrode pins 24A and 24B of the second casing 20 can be connected to the female contacts 7A and 7B of the first casing 10, the second casing 20 is connected to the first casing 10 to be transported in a compact size.

According to the plug conversion adapter according to this embodiment, since the cap 2 can be mounted on the tip end portion of the plug conversion adapter, the electrode pins 1A and 1B can be covered and protected by the cap 2, and thus the electrode pins 1A and 1B can be prevented from being damaged during transportation. In addition to the function of protecting the pair of electrode pins 1A and 1B, the cap 2 also has a function of preventing an earthing electrode (not illustrated) from being exposed by the cap 2 in a case where the cap 2 is mounted on the first casing 10 or the second casing 20.

That is, according to the plug conversion adapter according to this embodiment, since the first casing 10 provided with the sockets 7 that receive a predetermined type of plug, and the second casing 20 provided with the earth insertion opening pins 25, 26, and 27 that form different types of plugs are included, the plug conversion adapter can cope with a plurality of types of plugs in which the shapes of the electrode pins are different. In addition, since the interval between the pair of electrode pins 1A and 1B can be controlled by operating the pair of first movable members 5A and 5B, the plug conversion adapter can be used in a larger number of types of AC power plug sockets. Furthermore, since the interval between the first movable members 5A and 5B can be restricted by the second movable member 3 at a maximum, even in the case of the AC power plug socket that has a structure in which the shutter is opened by pushing both corners of the pair of electrode pin insertion openings, the shutter can be easily opened.

While the embodiment of the invention has been described above, the invention is not limited to the above-described embodiment, and includes variations. That is, the shapes, sizes, intervals, arrangements, and the like of the pins, members, casings, and the like are merely examples, and various modifications other than the above-described forms may form the variations of the invention.

What is claimed is:

1. A plug conversion adapter Which is able to convert a predetermined type of plug into a plurality of other types of plugs comprising:

a first casing in which a socket that receives the predetermined type of plug is provided;

a pair of electrode pins which protrude from the first casing to be parallel to each other and form at least a part of the other types of plugs;

a pair of first movable members which respectively hold the pair of electrode pins, and are disposed to move in a direction in which an interval between the pair of electrode pins is changed while holding the pair of electrode pins to be parallel to each other; and a second movable member which is disposed in the first casing to move between a first position at which the interval between the pair of electrode pins is variable by allowing movement of the pair of first movable members and a second position at which the interval between the pair of electrode pins is fixed by restricting the movement of the pair of first movable members, and is positioned at the second position when the interval between the pair of electrode pins is maximized to releasably restrict movement of the pair of electrode pins by the first movable members.

2. The plug conversion adapter according to claim 1, wherein the pair of first movable members include a first elastic member which biases the pair of first movable members in a direction in which the pair of first movable members become separated from each other, and the first casing includes a pair of locking portions which respectively lock the pair of first movable members so as not to allow the pair of electrode pins to be separated from each other over a certain movable range, and a pair of openings which respectively expose operating portions of the pair of first movable members to the outside by a biasing force of the first elastic member.

3. The plug conversion adapter according to claim 1, wherein the second movable member includes:

a movement operating portion which is allowed to penetrate through a long hole that is open in the first casing and is exposed to the outside of the first casing; and a body portion which is formed to have a greater width than that of the movement operating portion and is prevented from penetrating through the long hole.

4. The plug conversion adapter according to claim 1, further comprising:

a guide member which protrudes between the pair of first movable members in the first casing and guides the second movable member to slide in parallel to the pair of electrode pins.

5. The plug conversion adapter according to claim 4, further comprising:

an engaging mechanism which releasably fixes the position of the second movable member when the second movable member is positioned at the second position.

6. The plug conversion adapter according to claim 5, wherein the engaging mechanism includes:

a protrusion which is formed in a part of the guide member; and an oscillating wall which is provided in the body portion of the second movable member and is engaged with the protrusion while being able to be disengaged therefrom.

7. The plug conversion adapter according to claim 1, further comprising:

a second casing provided with an earth insertion opening pin that forms the other types of plugs with the pair of electrode pins, wherein the first casing includes a mounting portion on which the second casing is detachably mounted, on a surface that opposes a surface where a long hole is formed.

8. The plug conversion adapter according to claim 2, wherein the second movable member includes:

a movement operating portion which is allowed to penetrate through a long hole that is open in the first casing and is exposed to the outside of the first casing; and a body portion which is formed to have a greater width than that of the movement operating portion and is prevented from penetrating through the long hole.

* * * * *